US005369887A

United States Patent [19]

Keevers

[11] Patent Number: 5,369,887

[45] Date of Patent: Dec. 6, 1994

[54] POWERED COPING SAW

[76] Inventor: Brian Keevers, 3820 Hilton Dr., Indianapolis, Ind. 46237

[21] Appl. No.: 166,202

[22] Filed: Dec. 10, 1993

[51] Int. Cl.[5] ..... B27B 19/00

[52] U.S. Cl. ..... 30/394; 30/509

[58] Field of Search ..... 30/166.3, 392, 393, 30/394, 507, 509; 74/50

[56] References Cited

U.S. PATENT DOCUMENTS

| | | | |
|---|---|---|---|
| 1,324,032 | 12/1919 | Buell et al. | 30/394 |
| 1,491,134 | 4/1924 | Northall . | |
| 1,661,217 | 3/1928 | Farrell | 30/392 |
| 1,775,692 | 9/1930 | Plut | 30/394 |
| 2,206,614 | 7/1940 | O'Hern | 30/392 |
| 2,239,681 | 4/1941 | Marshall | 30/393 |
| 2,721,586 | 10/1955 | Hill | 30/394 |
| 4,048,891 | 9/1977 | Pearl | 83/528 |
| 4,272,996 | 6/1981 | Sauerwein | 30/394 |
| 5,027,518 | 7/1991 | Adomatis | 30/392 |
| 5,134,777 | 8/1992 | Meyer et al. | 30/392 |

FOREIGN PATENT DOCUMENTS 1369950 10/1974 United Kingdom .

*Primary Examiner*—Eugenia Jones
*Assistant Examiner*—Hwei-Siu Payer
*Attorney, Agent, or Firm*—Bose McKinney & Evans

[57] ABSTRACT

A powered coping saw has a frame that includes a first leg, a second leg and a third leg. A blade is reciprocally movable in a first and second direction with respect to the frame. First and second blade mounting brackets are provided for mounting the respective first and second ends of the blade. A blade driver is coupled to both the first and the second blade mounting brackets for actively driving both the first and the second ends of the blade in both the first and the second directions. The blade driver includes a motor, a transmission, a first drive member, and a first pivoting arm member. The first pivoting arm member has a first end pivotally coupled to the first drive member, and a second end. A reciprocally moving arm member has a first end pivotally coupled to the second end of the first pivoting arm member, and a second end. A second pivoting arm member has a first end pivotally coupled to the second end of the reciprocally moving arm member, and a second end. A second drive member is pivotally coupled to the second end of the second pivoting arm, and is coupled to the second blade mounting bracket for actively, reciprocally driving the second blade mounting bracket (and hence the blade) in both the first and second directions.

19 Claims, 7 Drawing Sheets

POWERED COPING SAW

TECHNICAL FIELD OF THE INVENTION

The present invention relates to powered hand tools, and in particular to a powered saw.

BACKGROUND OF THE INVENTION

Saws have been in use for centuries to cut work pieces, such as wood boards and metal bars. A wide variety of different types of saws exist, having a wide array of shapes and sizes. The shape or size of a saw type is dictated largely by the particular use to which the saw is placed.

Originally, saws were hand operated. As such, the only way in which the blade moved was through movement of the blade by the user. Recently, various types of powered saws have come into use. Most powered saws existing currently are driven either by an electric or pneumatic motor. Of the many types of saws that exist, the saw of interest to the present invention is a coping saw. A coping saw is a saw used at various angles to create a coped appearance. Coping saws are particularly useful in cutting crown moldings used in building interiors. A typical coping saw has a relatively thin, generally linear saw blade that is held at its opposite ends by a U-shaped frame. It differs from most saws, in that a coping saw blade must be supported at both of its ends. By contrast, a keyhole saw blade (as with most other saw blades) is supported either only at one end, or only at its center (with a circular saw).

Heretofore, most coping saws have been hand operated. Because of the configuration of a coping saw, it has been difficult to create an effective power driven coping saw.

One example of a powered coping saw known to applicant is shown in Adomatis U.S. Pat. No. 5,027,518. Adomatis discloses a coping saw that powers the blade by driving one side of the blade. The "driven end" saw of Adomatis' blade appears to be driven by a rotating disk that includes an eccentrically mounted pin which serves as a cam, to convert the rotary movement of the disk to reciprocal movement of the blade. The "non-driven" end of the Adomatis device is moved by a spring arrangement, and is not believed to be actively driven.

In addition to the Adomatis reference discussed above, other patents are known to applicant which relate to various types of powered saws. For example, Northall U.S. Pat. No. 1,491,134 relates to a powered saw which employs a bearing casing in which is contained a crank shaft. The crank shaft is provided with two cranks. The inner end of the crank shaft has a bearing in the side of the casing. The crank shaft is connected by means of a pitmen with the ends of the saw blade, whereby, when the crank shaft is driven, the blades will be driven in opposite directions by the cranks and pitmen.

Pearl U.S. Pat. No. 4,048,891 discloses a cutter mechanism for cutting sheet material. Pearl uses an eccentric cam mounted on a fly wheel to cause reciprocal movement of the blade. The opposite end of the blade is connected to a body which is reciprocally, slidably moveable in a slide body.

Myers U.S. Pat. No. 5,134,777 discloses the use of scotch-yoke mechanism to drive a reciprocal saw through a rotating eccentric cam. The Myers device also includes a somewhat complicated planetary gear mechanism and actuator for shifting a ring gear about its central axis to vary the stroke of the blade holder.

Lindley British Patent Specification No. 1,369,950 relates to a pneumatically driven saw which uses a scotch-yoke drive system. Lindley's scotch-yoke drive mechanism is best shown in FIG. 5 of the Lindley patent. In Lindley, the rotation of a crank lever rotates a crank pin. The crank pin engages a slot to reciprocally move the hack saw frame and hence the hack saw blade.

Although the saws discussed above likely perform their functions in a workmanlike manner, room for improvement exists. In particular, room for improvement exists in providing a powered coping saw capable of driving both ends of the saw blade so that the saw blade is "pulled" through the work piece in both directions of movement.

It is therefore one object of the invention to provide a powered coping saw which reciprocally, actively moves the blade in both directions of movement.

SUMMARY OF THE INVENTION

In accordance with the present invention, a powered saw comprises a frame and a blade. The blade is reciprocally moveable in a first and a second direction with respect to the frame. The blade has a first end and a second end. A first blade mounting means is provided for mounting the first end of the blade, and a second blade mounting means is provided for mounting the second end of the blade. A blade driving means is coupled to both the first and the second blade mounting means for actively driving both the first and the second ends of the blade in both the first and the second directions.

Preferably, the blade driving means includes a first drive member coupled to the blade mounting means. The first drive member is reciprocally moveable along a line generally parallel with the blade means. A second drive member is also provided which is coupled to the second blade mounting means, and is reciprocally moveable along a line generally parallel with the blade means. Additionally, the driving means also includes a first pivoting arm member having a first end pivotably coupled to the first drive member, and a second end. A reciprocally moving arm member is provided which has a first end pivotably coupled to the second end of the first pivoting arm member, and a second end. A second pivoting arm member is also provided which has a first end pivotably coupled to the second end of the reciprocally moving arm member, and a second end pivotably coupled to the second drive member. The arms and drive members cooperate to actively move the blade in both the first and second directions.

One feature of the present invention is that driving means is provided which actively drives a linear, reciprocally moving blade in both directions. This feature has the advantage of "pulling the blade" in both directions through the work piece being cut by the blade. As will be appreciated, a saw blade having the shape and dimensions of a coping saw blade is generally quite flexible. When pushing a coping saw blade through the work piece, flexural stress is exerted on the blade. By pulling the blade in both directions, this flexural stress is reduced. The ability of the applicants' invention to drive the blade actively at both ends of the blade enables the applicants' saw blade to be pulled in both directions through the work piece. The applicants believe that the reduced stress placed on the blade will: (1)

increase the efficiency of the saw; (2) improve the characteristics of the "cut" of the saw; and (3) extend the useful life of the blade.

It is also a feature of the present invention that a blade driving mechanism is provided which maintains a generally constant spacing between the first and second ends of the saw blade. This constant spacing also has the advantage of helping to reduce flexural stress on the blade.

Another feature of the present invention, is that the blade driving means includes a pair of pivoting arms coupled to a reciprocating arm, for transmitting power to the second end of the blade (that end of the blade separated spatially from the end of the blade closest to the motor). These pivoting and reciprocal arms are disposed within a U-shaped portion of the frame. The applicant's pivoting and reciprocating arm arrangement has the advantage of providing the applicant's device with a direct-link drive system, that transmits power from the first end of the device to the second end of the blade for actively moving the blade in both directions. This transmission of power is accomplished by a drive means which is positioned on the saw in a place where it will not interfere with the movement of the saw or the operation of the saw by the user.

These and other features and advantages of the present invention will become apparent to those skilled in the art upon review of a detailed description of the preferred embodiment of the present invention.

DETAILED DESCRIPTION OF PREFERRED EMBODIMENTS

Figure 1:
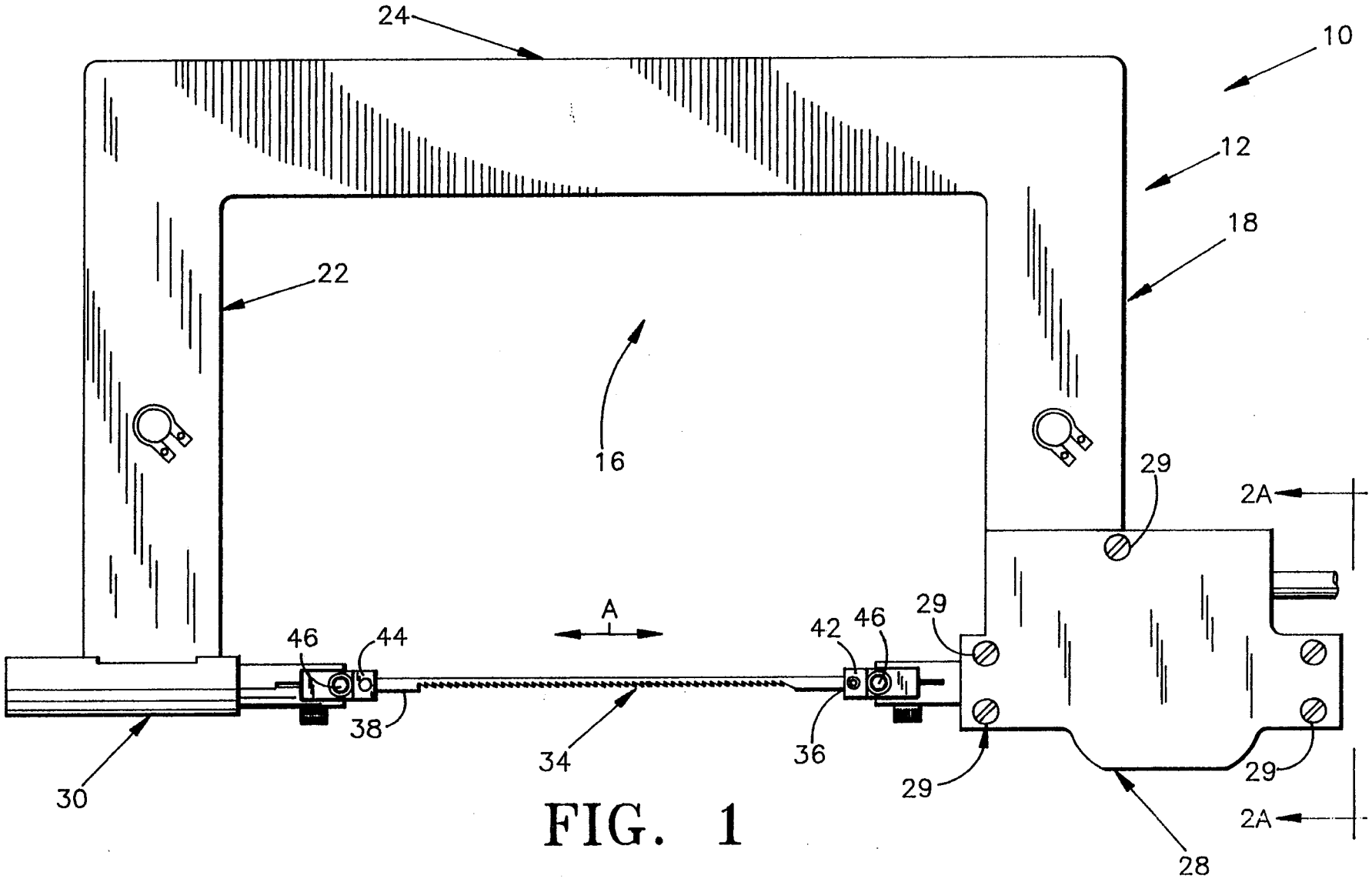
FIG. 1 is a top plan view of the saw of the present invention.
Figure 2B:
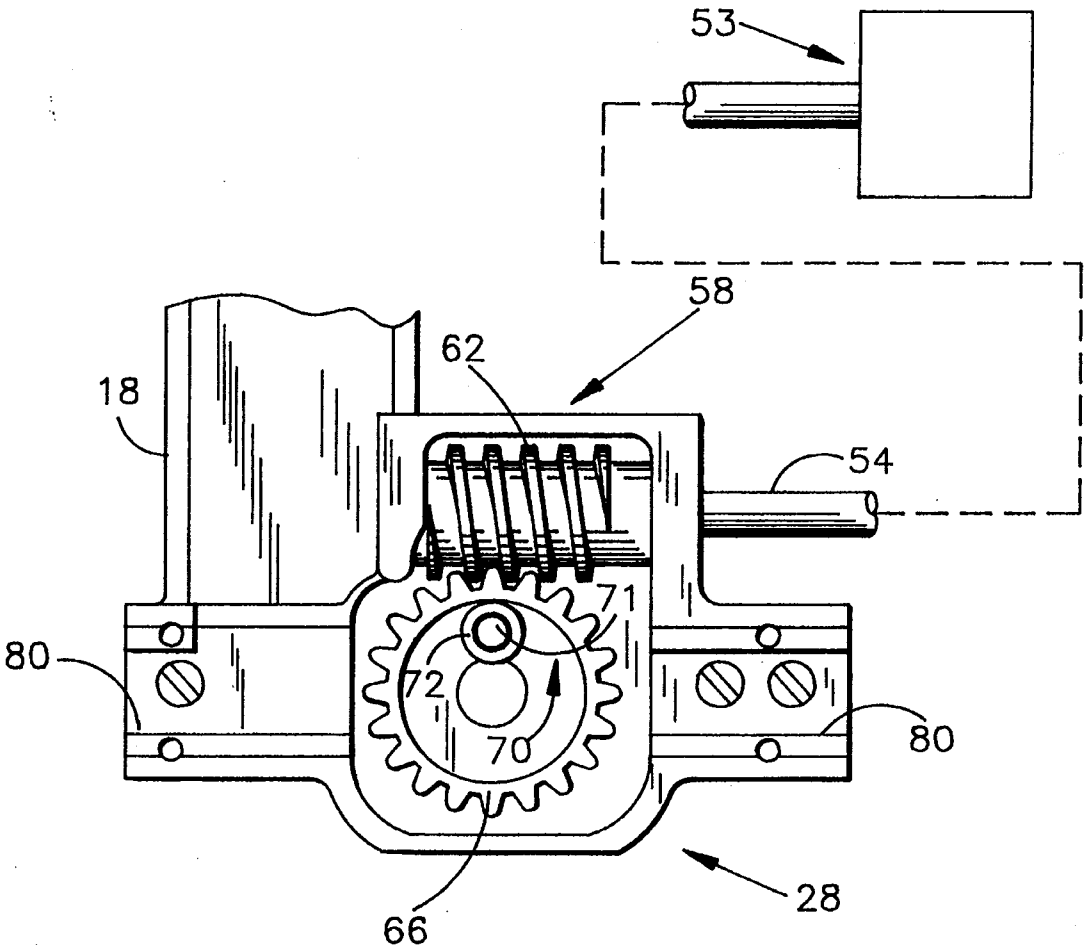
FIG. 2B is a sectional view taken along lines 2B—2B of FIG. 2A.
Figure 2A:
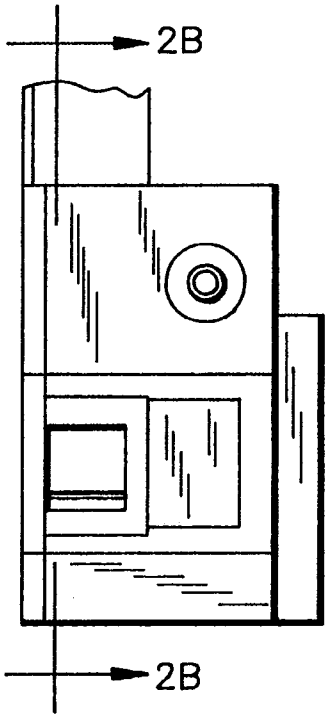
FIG. 2A is an enlarged end view of the drive housing portion of the saw of the present invention.

A powered coping saw 10 of the present invention is shown in FIGS. 1 and 2 as including a frame 12 having an interior. The frame 12 is generally made from a rigid, durable material such as metal or aluminum. The frame 12 must be durable, strong enough, and rigid enough to hold the various components discussed below, and to withstand the normal stresses imposed on the coping saw 10 during its use cutting work pieces. As will be appreciated, the nature of the use to which the saw is placed mandates clearly that the device not be fragile.

The frame 12 includes a U-shaped portion 16 which includes a first leg 18, a second leg 22 and a third leg 24. The U-shaped portion 16 is generally a hollow tube having a rectangular cross-section to form an interior into which a portion of the drive mechanism is placed.

The frame 12 also includes a drive housing portion 28. Drive housing portion 28 is disposed adjacent to the first leg 18 of the U-shaped portion 16, and contains a hollow interior, which is accessible through the removal of screws 29. A generally hollow, cylindrical sleeve 30 is also a part of the frame 12, and is disposed adjacent to the end of second leg 22.

The powered coping saw also includes a generally linear saw blade 34 of the type commonly used with coping saws. The saw blade 34 is reciprocally movable in both first and second directions, which directions are 180° apart as indicated by arrows A.

In one embodiment known to applicant, the saw blade 34 is approximately 5.5 inches (14 cm.) in length, and approximately 3/32nds of an inch (0.24 cm.) in height. The thickness of the blade is best measured in hundredths or thousandths of an inch. The dimensions given above are typical dimensions of a coping saw blade. As will be appreciated, a blade 34 having the dimensions discussed above will generally be somewhat flexible, so that when pushed through a work piece (such as a block of wood being cut, the blade 34 will tend to flex or twist, and thus undergo flexural stress. Over time, this stress can weaken the blade and thus shorten its lifetime. Additionally, the flex of the blade through a work piece can affect the quality of the cut made by the blade.

Figure 3:
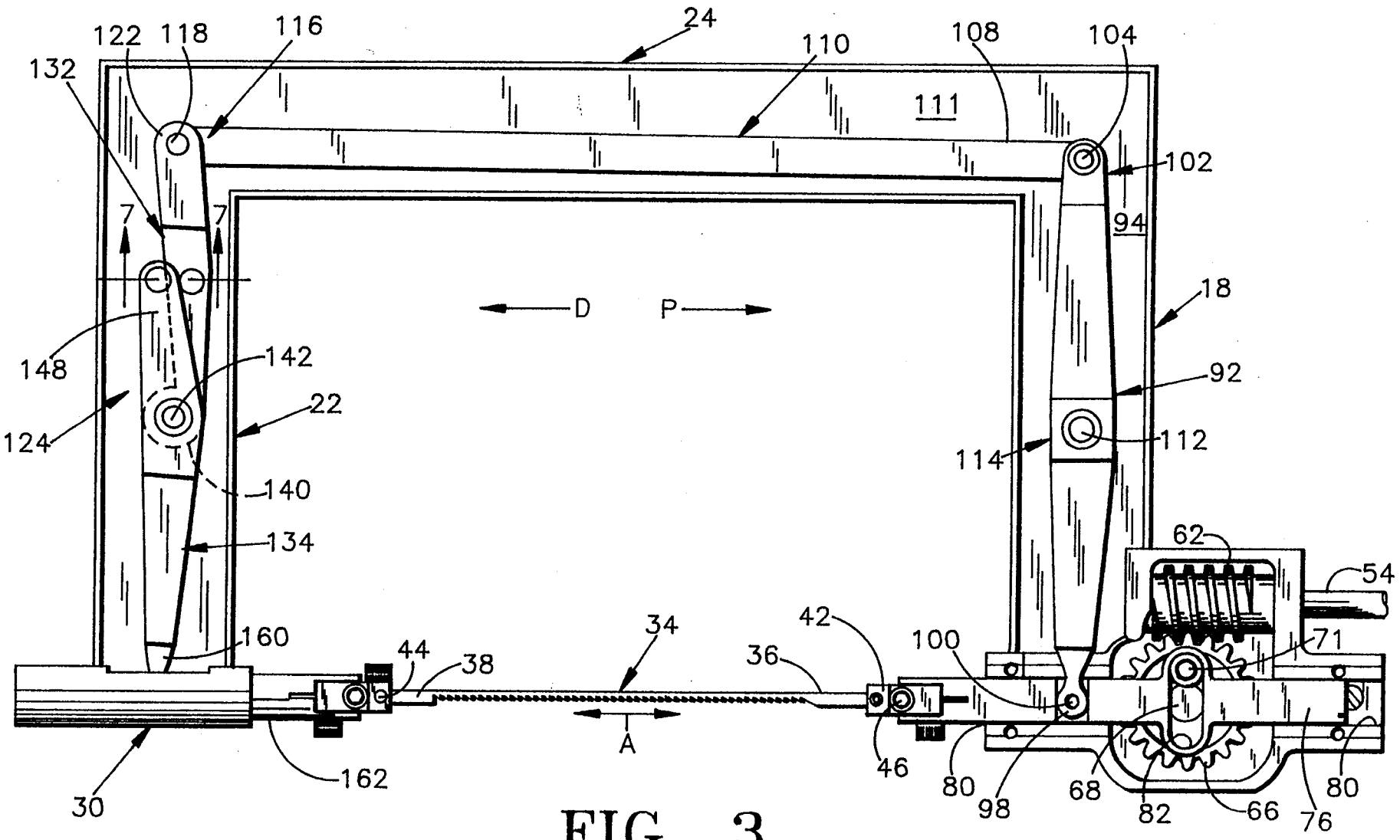
FIG. 3 is a top plan view of the present invention, with the outer casing removed, showing the scotch-yoke mechanism at 270 degrees past top dead center.

The saw blade 34 includes a first end 36 disposed near the first leg 18 of the frame 12, and a second end 38 disposed near the second leg 22 of the frame 12. A first blade mounting means 42 is provided for mounting the first end 36 of the blade 34 to a part of the blade driving means, and hence ultimately, the frame 12. A second blade mounting means 44 is provided for mounting the second end 38 of the blade 34 to a portion of the driving means of the device 10. An Allen screw 46 is provided on each of the blade mounting means 42, 44 for permitting removal and replacement of the blade 34 in the mounting means 42, 44. A blade driving means is provided for reciprocally driving the saw blade 34. Turning now to FIGS. 2, 2B and 3, the blade driving means includes a motor 53 (FIG. 2B) having an output shaft 54. An example of a motor which will function in the present invention is a 22,000 RPM rated pneumatic motor manufactured by Suntech.

The output shaft 54 of the motor is coupled to a transmission 58. Transmission 58 basically comprises a scotch-yoke type mechanism, and includes a worm gear 62 fixedly coupled to the output shaft 54. The worm gear 62 meshes with a spur gear 66. The rotation of the worm gear 62 about its axis (defined by output shaft 54) causes rotation of the spur gear 66 about its axis 68.

The spur gear 66 includes a plurality of radially outwardly facing teeth. The spur gear 66 rotates about an axis 68, which axis 68 is generally perpendicular to the axis of the worm gear 62 and output shaft 54. The spur gear 66 carries a roller 70 on its side. Roller 70 includes an upstanding pin 71 which is surrounded by a generally cylindrical bearing 72. Bearing 72 can take the form of a cylindrical "self-oiling" brass bearing, or a cylindrical beating made from delrin, nylon, or some other type of plastic having good lubricating qualities. Roller 70 serves as a cam for engaging first drive member 76.

As best shown in FIG. 3, first drive member 76 comprises a shaft having a generally rectangular cross-section. The first drive member 76 is slidably received, and supported by sleeves 80. The sleeves 80 include portions on either side of spur gear 66. First drive member 76 also includes a cam follower portion 82. The cam follower portion 82 of the first drive member 76 comprises an oval shaped race, with the long axis of the oval shaped race being disposed generally perpendicular to the direction of the reciprocal linear movement of the first drive member 76. The width of the follower portion is generally only slightly greater than the diameter of the roller 70. The eccentric, rotary movement of a roller-cam 70 through its engagement of the oval-like cam follower portion 82 causes the first drive member 76 to reciprocate slidably in the sleeves 80. Through the transmission 58, the rotary movement of the motor (not shown) and output shaft 54 is translated into generally linear, reciprocal movement of the first drive member 76.

The drive means for driving the saw blade 34 includes a first pivoting arm 92. First pivoting arm 92 is generally rigid, and can be made of a durable rigid material such as bar-steel or aluminum. The first pivoting arm of an embodiment made by applicant is approximately 5.75 inches (14.6 cm.) in length and is disposed in the interior 94 of the first leg 18 of the U-shaped portion 16 of the frame 12. The first pivoting arm 92 includes a first end 98 which is pivotably coupled by a pivot pin 100 to the first drive member 76. The first pivoting arm 92 also includes a second end 102 which is pivotably coupled by a pivot pin 104 to the first end 108 of a reciprocally moving arm 110. The first pivoting arm 92 also includes a middle portion 114 that includes a pivot pin 112, about which the first pivoting arm 92 pivots.

Reciprocally moving arm 110 is disposed in the interior 111 of the third leg 24 of the frame 12. In one preferred embodiment of the present invention, the reciprocally moving arm 110 is approximately 10.5 inches (26.67 cm.) in length. The reciprocally moving arm 110 is generally made of a rigid, unbending material such as bar-steel, aluminum or the like, and is sufficiently rigid so that the reciprocally moving arm 110 will not flex like a cable when being moved by the first pivoting arm 92. Reciprocally moving arm 110 is disposed in generally the same plane as the pivoting arm 92. The second end 116 of the reciprocally moving arm 110 is pivotably coupled by a pivot pin 118 to the first end 122 of a second pivoting arm member 124.

The second pivoting arm 124 differs from the first pivoting arm 92, in that the second pivoting arm 124 is a compound arm. Second pivoting arm 124 includes a first arm portion 132 and a second arm portion 134 which are separable and adjustably positionable with respect to each other. Although the total effective length of the second pivoting arm 124 is generally equal to that of the first pivoting arm 92, the combined length of the first 132 and second arm 134 portions (if laid end to end) is substantially greater than the total effective length of the second pivoting arm 124, as some overlap exists among the first and second arms portions 132, 134.

The first arm portion 132 includes a first end 122, which is also the first end 122 of the second pivoting arm 124. The second end 140 of the first arm portion 132 is pivotably coupled to a second pivot pin 142. Second pivot pin 142 is positioned generally in the middle of the "effective length" of the second pivoting arm member 124. The first end 148 of the second arm portion 134 is fixedly coupled to the first arm portion 132 by an adjustment means 158.

Figure 7:
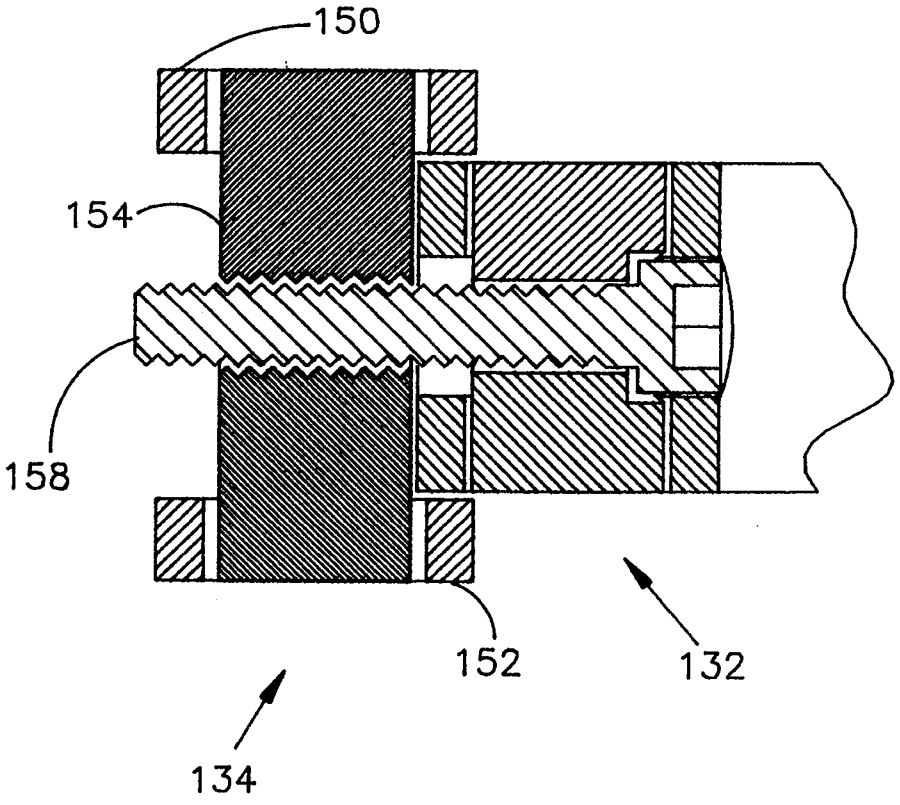
FIG. 7 is an enlarged sectional view taken along lines 7—7 of FIG. 3.

The coupling between the first and second arm portions 132, 134 is best shown in FIG. 7. The first end 148 of the second arm portion 134 is generally fork-like, and includes a pair of parallel, plate-like tines 150, 152 which interiorly receive the second end 140 of the first arm portion 132 therebetween. A cross member 154 is placed at the first end 148 and arm portion 134 to extend between the tines 150, 152. An adjustment means such as threaded shaft 158 is threadedly engaged in the cross member 154 and the arm portion 132. The threaded engagement of the adjusting means shaft 158 allows the space (distance) between the first and second arm portions 132, 134 to be adjusted. Through this adjustment, the second end 160 of second arm portion 134 is allowed to pivotably engage the second drive member 162 in its proper position. Since the second end 160 of the second arm portion 134 is also the second end of the second pivoting arm 124, the adjustment means 158 permits the user to adjust the relative position of the second arm 124 and the second drive member 162. Once the proper adjustment between the first and second arm portions 132, 134 is achieved, the threaded shaft adjustment means 158 maintains the proper fixed spatial relation between the second arm portions 132, 134, and also maintains the second end 160 of the second arm 124 in its proper position relative to the second drive member 162.

The second end 160 of the second arm portion 134 is engaged by a pivot pin (not shown) to the second drive member 162. The pivot pin forms a pivot axis parallel to the pivot axis formed by second pivot pin 142. Second drive member 162 is generally cylindrical in shape, and is sized to be slidably received in sleeve 30, for linear, reciprocal movement therein. The second drive member 162 is coupled to the second blade mounting means 44 which, as described above, is provided for mounting the end 38 of the blade 34 to the second drive member 162.

The operation of the device will now be discussed with reference to FIGS. 3-6.

For ease of explanation, directions will be given in terms of "proximal" and "distal". The proximal direction is the direction indicated by arrow P, toward the "motor end" of the coping saw 10. The distal direction is that direction indicated by arrow "D," toward the second pivoting arm member 124 of the device 10.

Figure 4:
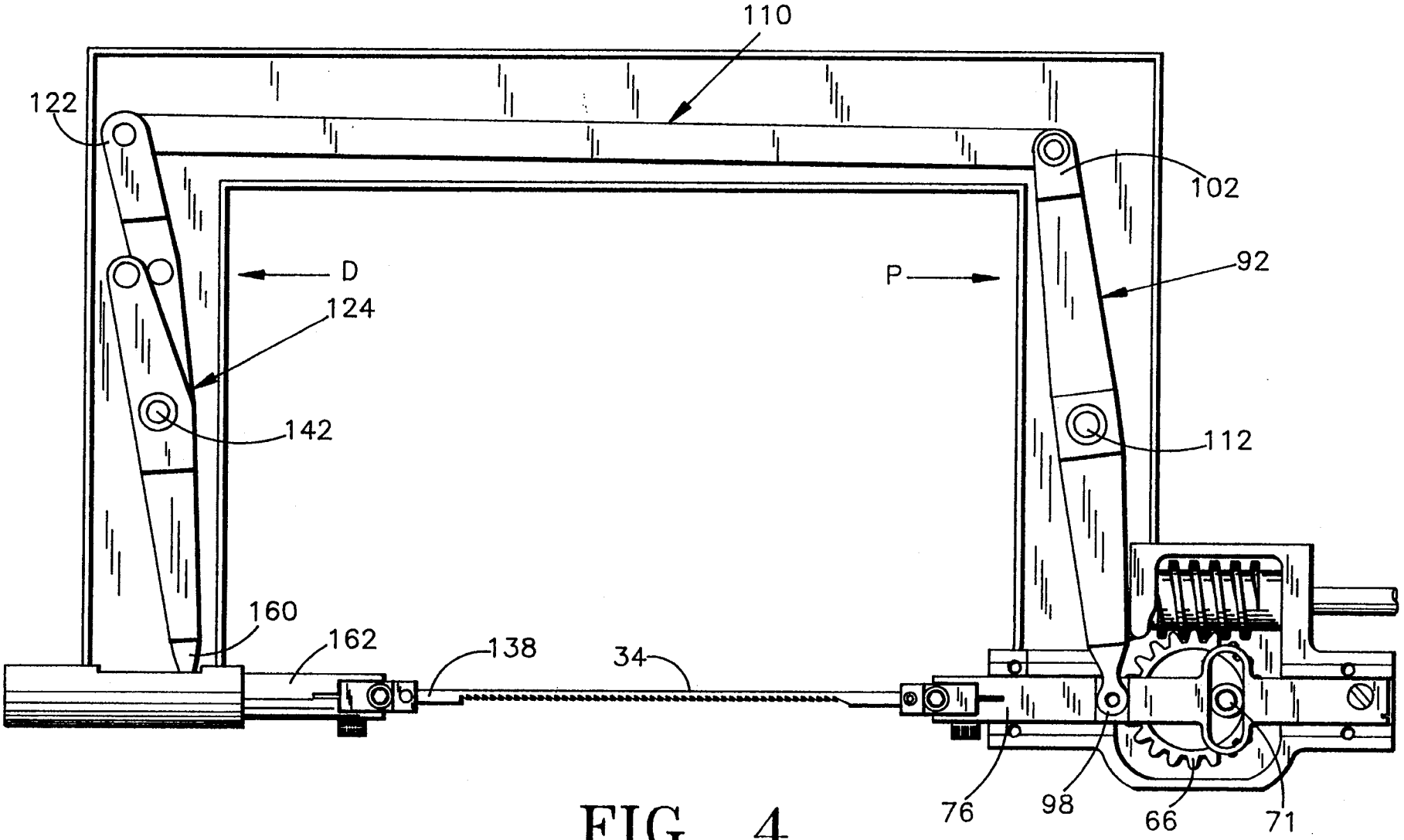
FIG. 4 is a plan view similar to FIG. 3, showing the scotch-yoke mechanism at top dead center.

As best shown in FIG. 4, the spur gear 66 is positioned so that the cam roller 70 is positioned at "top dead center," and the first drive member 76 is moved to its fully retracted position. In other words, first drive member 76 and blade 34 are moved to the furthest proximal extent in their cycle. In this position, the first pivoting arm member 92 is rotated about pivot pin 112 to its point of furthest movement in a counterclockwise direction. As such, the first end 98 of the first pivoting arm member 92 is extended fully in a proximal direction, and the second end 102 is extended fully in a distal direction. Consequently, the reciprocally moving arm 110 is extended fully in a distal direction. The reciprocal, linear movement of the reciprocally moving arm 110 in a distal direction causes the second pivoting arm 124 to also rotate in a counterclockwise direction, such that the first end 122 of the second pivoting arm 124 is at its fully distal position, and the second end 160 is in its fully proximal position. Counterclockwise rotation of the second pivoting arm member 124 about pivot pin 142 causes the second drive member 162, and hence the second end 38 of the blade 34 to be moved into that position which represents the furthest proximal extent of their movement in the cycle.

Figure 5:
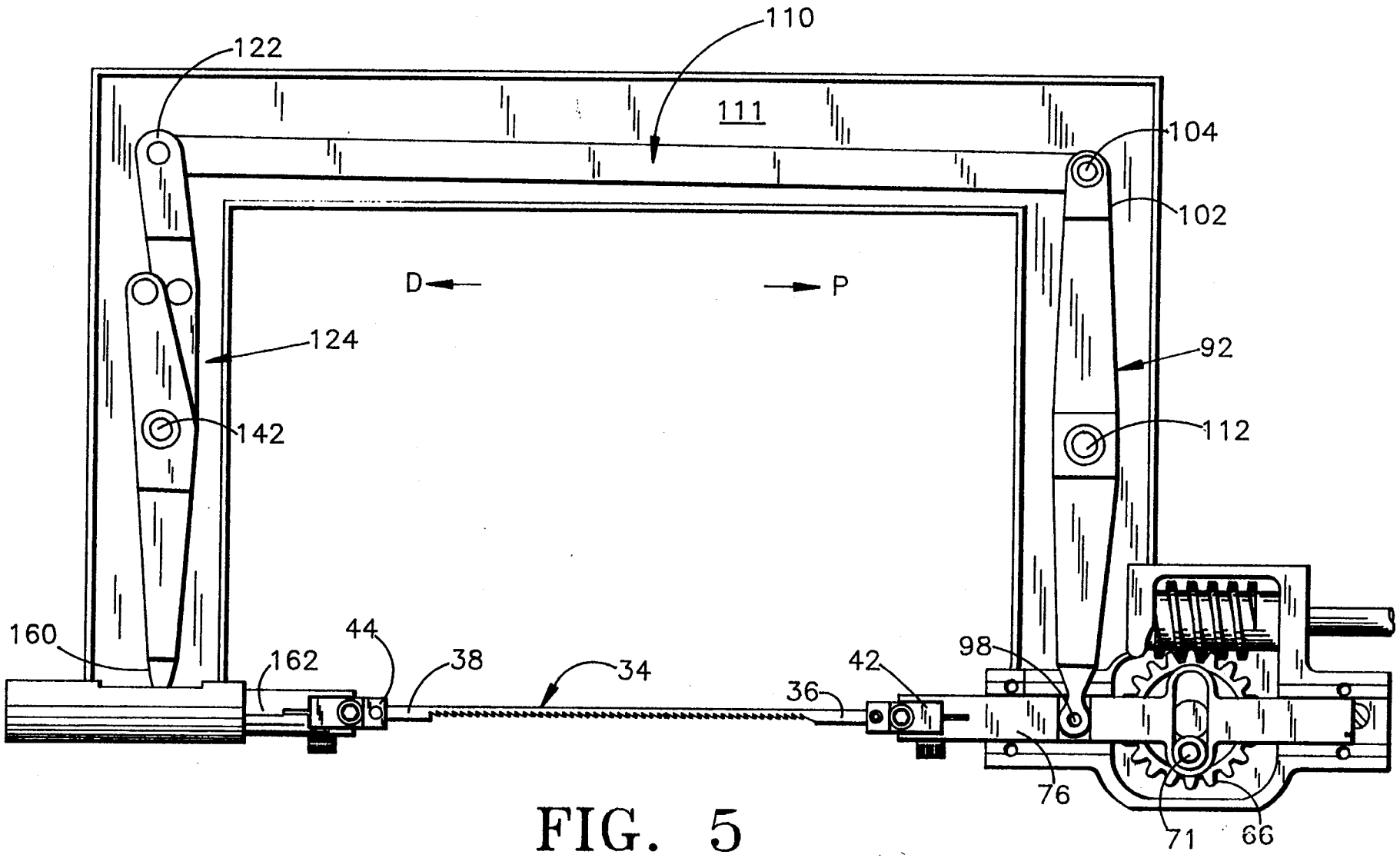
FIG. 5 is a plan view similar to FIG. 3, showing the scotch-yoke mechanism at 90 degrees past top dead center.

Turning now to FIG. 5, the spur gear 66 has rotated 90+ to move to a point wherein the cam roller 70 is 90° past top dead center. When so positioned, the driving means and blade 34 are in a "neutral" position. During the intervening portion of the cycle between top dead center (FIG. 4) and 90° past top dead center (FIG. 5), the first pivoting arm 92 has been moved in a clockwise direction so that it is disposed generally perpendicular to first drive member 76. As such, the first and second ends 98, 104 are at approximately the same relative proximal/distal position. Reciprocating arm 110 is moved to its neutral position, which causes the second pivoting arm 124 to be moved to its neutral position, wherein its first end 122 and second end 160 are at approximately the same relative proximal/distal position. To get into this position, the reciprocally moving arm 110 caused the second pivoting arm 124 to rotate in a clockwise direction about second pivot axis 142.

Through the direct-link, positive connection between transmission 58 and the second driving member 162, the movement of the blade 34 is accomplished through the active intervention of both the first driving member 76, and the second driving member 162. If the blade 34 were engaged in a work piece, the first driving member 76 would be pushing blade 34 through the work piece, while the second driving member 162 was pulling the blade 34 through the work piece. Because of the generally flexible nature of the blade 34, the pulling action of the second driving member 162 is especially important to reduce flexural strain on the blade 34, and to help prevent the blade 34 from becoming "bound" in the work piece because of the flex exerted when trying to push the blade 34 through the work piece.

Figure 6:
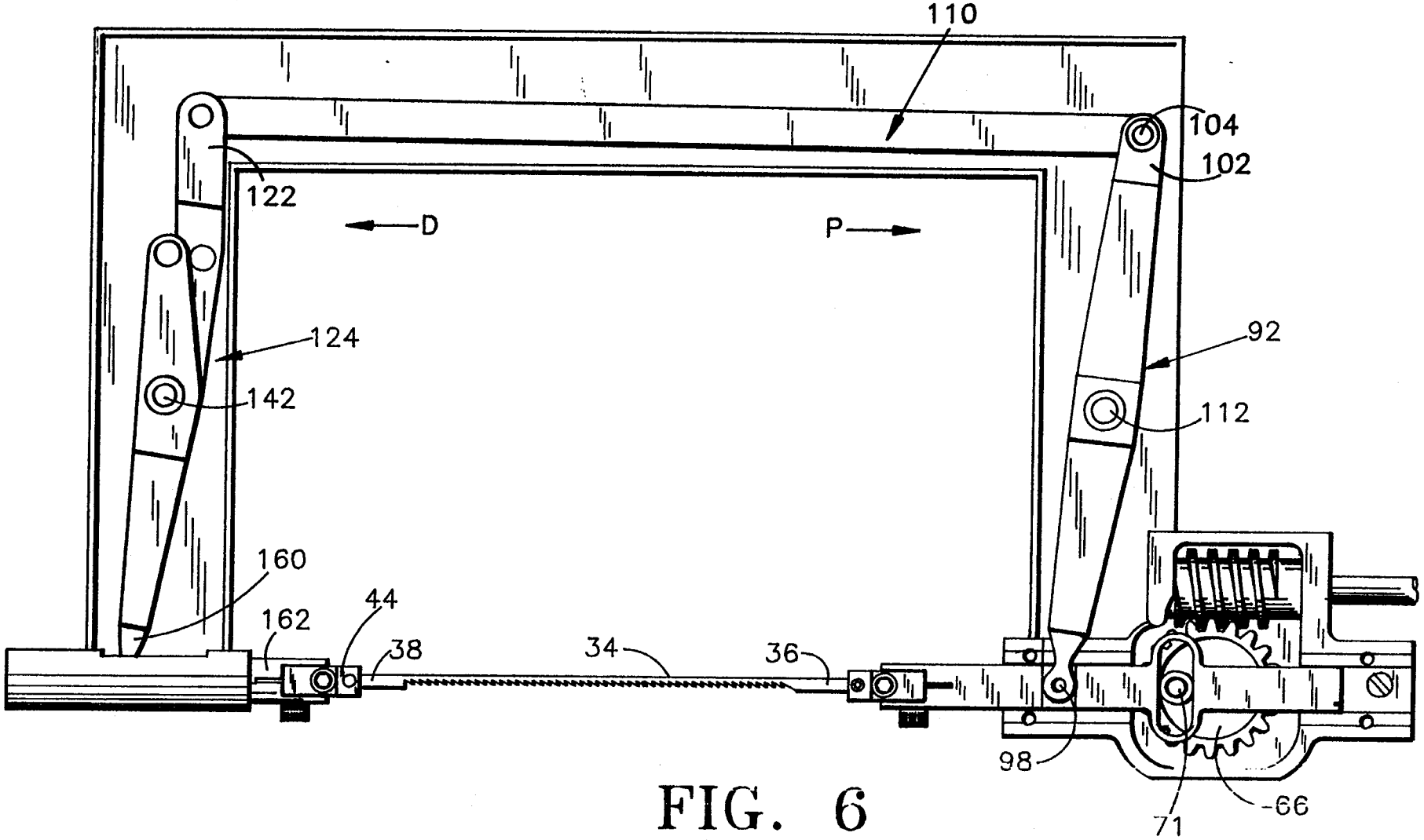
FIG. 6 is a plan view similar to FIG. 3 showing the scotch-yoke mechanism at 180 degrees past top dead center.

Turning now to FIG. 6, the blade 34 is shown in its fully "extended" position, or that position wherein it is moved to the furthest distal point in its cycle. As best shown in FIG. 6, the spur gear 66 is rotated to a position wherein the roller cam 70 is at its bottom dead center position. The movement of the roller cam 70 in the oval cam follower 82 has caused the first drive member 76 to move linearly within sleeve 80 to its fully extended position wherein it is at its furthest distal extent in its cycle. Movement of the drive mechanism in their cycle between the position shown in FIG. 5 and the position shown in FIG. 6 continues the generally clockwise movement of both the first pivoting arm member 92 and the second pivoting arm member 124 about their respective first and second pivot axes 112, 142. Additionally continued is the linear movement in a generally proximal direction of the reciprocally moving arm 110. At the position shown in FIG. 6, the first end 98 of the first pivoting arm member 92, and the second end 160 of the second pivoting arm member 124 are in their distal-most positions in their cycles. In a complementary manner, the second end 102 of the first pivoting arm and the first end 122 of the second pivoting arm 124 are in their proximal-most positions in their cycles. It is important to note that during their pivoting movement, the distance between the first end 98 of the first pivoting arm member 92, and the second end 160 of the second pivoting arm member 124 remains constant. This constant distance is also maintained between the first blade mounting means 42 and second blade mounting means 44. Hence, the distance between the first end 36 and the second end 38 of the blade also remains constant. This constant distance reduces and may well prevent flexural strain being placed upon die saw blade 34 as it moves through the work piece. During the portion of the cycle between that shown in FIG. 5, and that shown in FIG. 6, driving member 162 is being used to pull saw blade 34, as the first driving member 76 is to push saw blade 34.

Turning now to FIG. 3, it will be noted that the spur gear 66 continued its clockwise rotary movement to place the roller cam 70 at 270° past top dead center. When in this position, the first and second pivoting arms, 92, 124 reciprocally moving arm 110, drive member 76, 162, and blade 34 are generally in positions similar to that shown in FIG. 5. In the interval of the cycle between that of FIG. 6 and that of FIG. 3, the movement of the pivoting arms 92, 124 has been reversed, so that the first pivoting arm 92 is caused to pivot in a counterclockwise direction about its pivot axis 112, and the second pivot arm 124 is caused to pivot in a counterclockwise direction about its pivot axis 142. This movement through the first and second drive members 76, 162 causes the blade to be moved in a generally proximal direction. When so moved in this proximal direction, the drive member 76 exerts a pulling motion on the blade 34, and the second drive member 162 exerts a pushing movement on the blade 34. In both the proximal and distal directions, the blade 34 is being moved actively in both the first and second directions. Through the rigid-link mechanism, the first 36 and second 38 ends of the blade 34 are maintained at a constant spaced relation.

Turning now to FIG. 4, the cycle becomes complete when the roller cam 70 returns to top dead center.

Having described the invention in detail, and by reference to the preferred embodiments thereof, it will be apparent that modifications and variations are possible without departing from the scope of the invention as defined in the appended claims.

What is claimed is:

1. A powered saw comprising (a) a frame having a U-shaped portion and a sleeve means, the U-shaped portion including a first leg, a third leg disposed generally perpendicular to the first leg, and a second leg disposed generally perpendicular to the third leg, the sleeve means being disposed generally perpendicular and adjacent to the second leg, (b) a blade reciprocally moveable in a first and a second direction with respect to the frame, the blade having a first end and a second end, (c) a first blade mounting means for mounting the first end of the blade, (d) a second blade mounting means for mounting the second end of the blade, and (e) blade driving means coupled to both the first and the second blade mounting means for actively driving both the first and the second ends of the blade in both the first and the second directions, the blade driving means including (1) a motor means, (2) a transmission means for translating rotary motion of the motor means into linear, reciprocal motion, (3) a first drive member coupled between the transmission and the first blade mounting means, (4) a first pivoting arm member pivotable about a first pivot axis and having a first end pivotably coupled to the first drive member, and a second end, (5) a reciprocally moving arm member having a first end pivotably coupled to the second end of the first pivoting arm member, and a second end (6) a second pivoting arm member pivotable about a second pivot axis and having a first end pivotably coupled to the second end of the reciprocally moving arm member, and a second end, (7) a second drive member slidably received in the sleeve means for linear, reciprocal movement therein, the second drive member being pivotably coupled to the second end of the second pivoting arm member, and being coupled to the second blade mounting means for actively, reciprocally driving the second blade mounting means in both the first and the second directions.

2. The powered saw of claim 1 wherein the second pivoting arm member includes adjustment means for adjusting the linear position of the second pivoting arm member.

3. The powered saw of claim 1 wherein the second pivoting arm member includes (a) a first portion having a first end pivotably coupled to the second end of the reciprocally moving arm member, and a second end pivotable about the second pivot axis, and (b) a second portion movable with respect to the first portion, the second portion including a first end having an adjustment means for fixing the position of the first end of the second portion relative to the first portion, a middle portion pivotable about the second pivot axis, and a second end pivotably coupled to the second drive member.

4. A powered saw comprising a frame, a blade reciprocally moveable in a first and second direction with respect to the frame, the blade having a first end and a second end, the frame including a U-shaped member, the U-shaped member including a first leg disposed adjacent to the first end of the blade, a second leg disposed adjacent the second end of the blade, and a third leg extending between the first and second legs, the first leg including a first pivoting arm member, and the third leg including a reciprocally moving arm member, a first blade mounting means for mounting the first end of the blade, a second blade mounting means for mounting the second end of the blade, and blade driving means coupled to both the first and the second blade mounting means for actively driving both the first and second ends of the blade in both the first and the second directions.

5. The powered saw of claim 1 wherein the second leg has a second p,voting arm member, and a second pivot means about which the second pivoting arm member pivots and the first leg includes a first pivot member about which the first arm member pivots.

6. The powered saw of claim 5 wherein the first pivoting arm member is disposed generally at the middle of the first leg member, and the second pivoting arm member is disposed generally at the middle of the second leg member.

7. The powered saw of claim 5 wherein the blade driving means includes a first drive member coupled to the first blade mounting means, and reciprocally moveable along a line generally parallel with the blade.

8. The powered saw of claim 7 wherein the blade driving means includes a motor means, and a transmission means for translating rotary motion of the motor means into the linear, reciprocal motion of the blade.

9. The powered saw of claim 8 wherein the transmission includes a worm gear which meshes with a spur gear, and the spur gear includes an eccentric cam engageable with a cam follower.

10. The powered saw of claim 7 wherein the first pivoting arm member includes a first end pivotably coupled to the first drive member, the first pivoting arm member being disposed generally perpendicular to the first drive member.

11. The powered saw of claim 10 wherein the reciprocally moving arm member includes a first end pivotably coupled to a second end of the first pivoting arm member, the reciprocally moving arm member being disposed generally perpendicular to the first pivoting arm member, and the second pivoting arm member includes a first end pivotably coupled to a second end of the reciprocally moving arm member, the second pivoting arm member being disposed generally perpendicular to the reciprocally moving arm member.

12. The powered saw of claim 11 where the driving means includes a second drive member pivotably coupled to a second end of the second pivoting arm member, and being disposed generally perpendicular thereto.

13. The powered saw of claim 12 wherein the frame includes a sleeve means for slidably receiving the second drive member to permit linear, reciprocal movement of the second drive member in the sleeve means, the second drive member being coupled to the second blade mounting means for driving the second blade mounting means.

14. The powered saw of claim 5 wherein the first pivoting arm member, reciprocally moving arm member, and second pivoting arm member are rigid for maintaining the first and second ends of the blade in a generally constant spaced relation.

15. A powered saw comprising a frame, a blade reciprocally moveable in a first and second direction with respect to the frame, the blade having a first end and a second end, a first blade mounting means for mounting the first end of the blade, a second blade mounting means for mounting the second end of the blade, and blade driving means coupled to both the first and the second blade mounting means for actively driving both the first and second ends of the blade in both the first and the second directions wherein the blade driving means includes a first pivoting arm member, a reciprocally moving arm member coupled to the first pivoting arm member, and a second pivoting arm member coupled to the reciprocally moving arm member.

16. The powered saw of claim 15 further comprising a first pivot means about which the first pivoting arm member pivots, and a second pivot means about which the second pivoting arm member pivots, the first and second pivot means forming generally parallel pivot axes.

17. The powered saw of claim 15 wherein the blade driving means includes a first drive member coupled to the first blade mounting means, the first drive member being reciprocally moveable along a line generally parallel with the blade means, and a second drive member coupled to the second blade mounting means, the second drive member being reciprocally moveable along a line generally parallel with the blade.

18. The powered saw of claim 17 wherein the driving means includes (a) a first pivoting arm member having a first end pivotably coupled to the first drive member, and a second end, (b) a reciprocally moving arm member having a first end pivotably coupled to the second end of the first pivoting arm member, and a second end, and (c) a second pivoting arm member having a first end pivotably coupled to the second end of the reciprocally moving arm member, and a second end pivotably coupled to the second drive member.

19. The powered saw of claim 15 wherein the blade driving means includes a second drive member coupled to the second blade mounting means, and the frame includes a sleeve means for slidably receiving the second drive member to permit linear, reciprocal movement of the second drive member in the sleeve means.

* * * * *